United States Patent [19]

Mizuno et al.

[11] Patent Number: 4,835,447

[45] Date of Patent: May 30, 1989

[54] FLUORESCENT DISPLAY TUBE DRIVE APPARATUS

[75] Inventors: Tooru Mizuno, Nagoya; Shinichi Kiribayashi, Anjo, both of Japan

[73] Assignee: Nippondenso Co., Ltd., Kariya, Japan

[21] Appl. No.: 24,515

[22] Filed: Mar. 11, 1987

[30] Foreign Application Priority Data

Mar. 26, 1986 [JP] Japan ..... 61-68212

[51] Int. Cl.[4] ..... G09F 9/00

[52] U.S. Cl. ..... 315/169.1; 315/169.4; 340/767

[58] Field of Search ..... 315/169.1, 169.4, 287, 315/DIG. 4; 340/767, 813

[56] References Cited

U.S. PATENT DOCUMENTS 4,472,660 9/1984 Knothe et al. ..... 315/169.4
4,495,445 1/1985 Turney ..... 315/169.4

FOREIGN PATENT DOCUMENTS 59124934 9/1980 Japan .
57-205943 12/1982 Japan .
59-111239 6/1984 Japan .

*Primary Examiner*—David K. Moore
*Assistant Examiner*—T. Salindong
*Attorney, Agent, or Firm*—Cushman, Darby & Cushman

[57] ABSTRACT

A fluorescent display tube drive apparatus of the type used with a vehicle instrument panel or the like. The apparatus includes a transparent electrode arranged opposite to anodes and filaments. Ac voltages are applied to the filaments for the emission of thermoelectrons and a pulsating voltage is applied to the transparent electrode to cause pulsation of the potential difference between the filaments and the transparent electrode, thereby causing the thermoelectrons to impinge uniformly on the anodes.

8 Claims, 4 Drawing Sheets

FLUORESCENT DISPLAY TUBE DRIVE APPARATUS

BACKGROUND OF THE INVENTION

The present invention relates to an apparatus for driving a fluorescent display tube of the type in which the thermoelectrons emitted from the filaments forming the cathodes impinge against the anodes to cause the fluorescent substance on the anodes to emit light, thereby making the display tube suitable for use in general industrial applications.

This type of known fluorescent display tube has been disadvantageous in that as shown in FIG. 7, when the thermoelectrons emitted from filaments 2 impinge on anodes 4, the thermoelectrons emitted from the different filaments lie one upon another on the surface of the anodes 4 so that variations are caused in the degree of emission and relatively light and dark portions are produced. Methods have heretofore been proposed to overcome this problem of emission irregularity and one such method is disclosed in Japanese Patent Publication No. 59-24486. This method is schematically shown in FIG. 8 in which filaments 2 emit thermoelectrons to anodes 4 and an antistatic layer 40 is provided adjacent to each anode 4. The same positive potential as the anodes 4 with respect to the filaments 2 are always applied to a transparent electrode or diffusing electrode 1 and the antistatic layers 40 so that an electric field is produced and the densities of the electron streams flowing from the filaments 2 to the anodes 4 are diffused and averaged, thereby accomplishing a reduced brightness irregularity. However, this construction is not capable of preventing the occurrence of brightness irregularity in a display tube using no antistatic layers 40 and therefore a more effective brightness irregularity preventive measure is required. Also, there is another prior art method disclosed in JP-A No. 57-205943. As shown in FIG. 9, this method employs a plurality of filaments 2 which are each arranged to flow current in the opposite direction to that of the adjacent one and to thereby make uniform the potentials at the right and left ends of the filaments. In other words, while a phenomenon is caused in which there is a difference in potential between the right and left ends of each filament due to the voltage effect of the current flowing therein, the direction of current flow is changed alternately so that this potential unbalance is eliminated and a stream of electrons flows uniformly from each filament to the corresponding anode.

With the prior art method of JP-A No. 57-205943 shown in FIG. 9, however, the directions of currents $i_1$ and $i_2$ flowing in the filaments are made opposite to each other and this requires a special wiring, thereby complicating the construction. Also, there exists a need for a construction capable of accomplishing a greater reduction in the emission irregularity than that attained by the construction of FIG. 9. Further, there is a need for accomplishing a reduced emission irregularity by another construction different from the previously mentioned prior art constructions of FIGS. 8 and 9. Still further, there is a need for a fluorescent display tube which employs the construction of FIG. 9 and an additional construction to reduce the variations in emission to a greater extent.

SUMMARY OF THE INVENTION

With a view to meeting the foregoing requirements, it is an object of the present invention to provide a fluorescent display tube drive apparatus so designed that the paths of motion of thermoelectrons emitted from the filaments and reaching the anodes are changed so as to cause the thermoelectrons to uniformly impinge on the anodes and to thereby prevent the occurrence of emission irregularity.

To accomplish the above object, in accordance with the invention there is thus provided a fluorescent display tube drive apparatus including filaments, anode, a transparent electrode arranged on the opposite side of the filaments to the anodes, first ac power sources for applying ac voltages to the terminals of the filaments to supply a current to the filaments, and a second ac power source for applying a pulsating voltage to the transparent electrode to pulsate the potential difference between the filaments and the transparent electrode.

In accordance with the invention, due to the fact that a pulsating voltage is applied to the transparent electrode and moreover there is a momentarily varying potential difference between the transparent electrode and the filaments, if, for example, the thermoelectrons emitted from the filaments repel the potential of the transparent electrode, the thermoelectron streams flowing to the anodes from the filaments are decreased in width, whereas, if the potential of the transparent electrode and the thermoelectrons attract each other, the thermoelectron streams emitted from the filaments are increased in width. Then, such narrow-stream condition and wide-stream condition alternately take place from instant to instant in accordance with the varying potential difference between the filaments and the transparent electrode and this has the effect of causing the thermoelectrons to uniformly impinge on the anodes.

In accordance with the fluorescent display tube drive apparatus of this invention, the thermoelectrons emitted from the filaments impinge uniformly on the anodes so that the occurrence of any brightness irregularity is eliminated and the fluorescent display tube is allowed to provide a display of good quality. This, if the display tube is used with the instrument panel of a vehicle, for example, it is possible to provide a quality display surface which is free of misreading. Also, the same effect can be obtained with or without the antistatic layers and it is possible to use any of the various known filament constructions.

DESCRIPTION OF THE PREFERRED EMBODIMENTS

Figure 2:
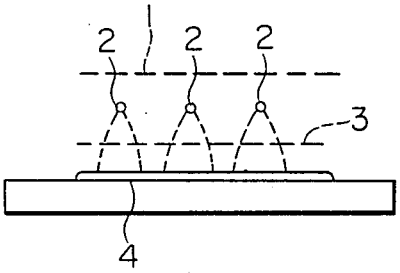
FIGS. 2 and 3 are schematic diagrams useful for explaining the emission conditions of thermoelectrons in the first embodiment.
Figure 3:
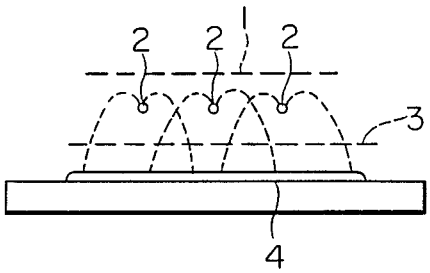

Preferred embodiments of a fluorescent display tube drive apparatus according to the invention will now be described with reference to the accompanying drawings. The first embodiment will be described briefly with reference to FIGS. 2 to 4. In FIG. 2, numeral 1 designates a transparent electrode, 2 filaments, 3 a grid, and 4 anodes. The thermoelectrons emitted from the filaments 2 impinge on the anodes 4 through the grid 3, thereby causing the anodes 4 to emit light. In this case, the transparent electrode 1 is arranged above the filaments 2 so that the thermoelectrons are made uniform by virtue of variations in the potential of the transparent electrode 1. FIG. 2 shows schematically the condition in which a negative voltage is applied to the transparent electrode 1 so that the thermoelectrons repel the transparent electrode 1 and impinge on the anodes 4. In this case, the width of the thermoelectronic streams is decreased. On the other hand, FIG. 3 shows the condition in which a positive potential is applied to the transparent electrode 1 to attract the thermoelectrons to some extent so that the thermoelectron streams are expanded to both sides and impinge on the anodes 4. In accordance with the invention, the conditions of FIGS. 2 and 3 are caused to occur alternately.

Figure 4:
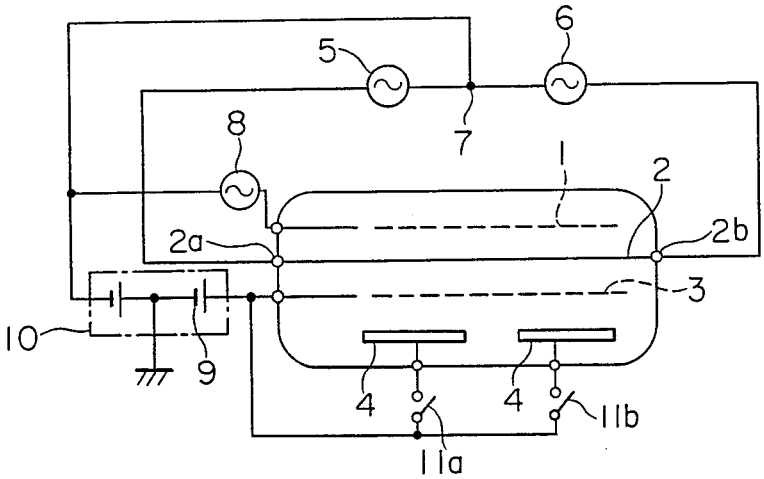
FIG. 4 is a schematic diagram for explaining the operating principle of the first embodiment.

Referring now to FIG. 4 useful for explaining the principle of the first embodiment, first ac power sources 5 and 6 are respectively connected to terminals 2*a* and 2*b* of the filaments 2 to supply ac current to the filaments 2. It is to be noted that actually the plurality of filaments 2 are arranged parallel to one another as shown in FIG. 2. The first ac power sources 5 and 6 generate ac voltages which are the same in phase so as to supply an ac current of a given frequency to the filaments 2. A center tap 7 is provided between the first ac power sources 5 and 6 and the center tap 7 is connected to a second ac power source 8. The second ac power source 8 is connected to the transparent electrode 1. As a result, the potential of the transparent electrode 1 varies alternately to the positive and negative sides of the potential of the center tap 7.

The center tap 7 is also connected to a first dc power source 10 which in turn is connected to the grid 3. In this case, the first dc power source 10 applies a constant positive voltage to the grid 3 so that the grid 3 performs the function of making uniform the thermoelectronic streams to some extent in a well known manner. Note that the grid 3 may be eliminated.

Numeral 9 designates a battery included in the first dc power source 10 and connected to the respective anodes 4 through switch means 11*a* and 11*b*, respectively.

With the construction described above, the thermoelectrons emitted from the filaments 2 impinge on the anodes 4 so that the anodes 4 emit light and provide a display corresponding to their shapes. Then, in accordance with the potential of the transparent electrode 1 varying alternately to the positive and negative sides in response to the second ac power source 8, the thermoelectronic streams are alternately decreased and increased in width as shown in FIGS. 2 and 3 and the thermoelectronic streams impinge uniformly on the anodes 4.

Further details of the construction of the first embodiment will now be described with reference to FIG. 1. Numeral 12 designates a transformer whose primary winding 12*b* is connected to a vehicle ac power source 13. This vehicle ac power source may be provided by converting the dc voltage of the battery to an ac voltage by a converter. The secondary side of the transformer 12 includes three windings of which the windings 5 and 6 correspond to the first ac power sources of FIG. 4. Numeral 7 designates the center tap. Of the three secondary windings, the winding 14 is connected to a rectifying diode 15 and a smoothing capacitor 16. As a result, a potential of −10 volts with respect to the ground potential is generated at a point 17 on the ungrounded side of the smoothing capacitor 16. Thus, the center tap 7 also has a potential of −10 volts with respect to the ground potential so that a potential of −10 volts with respect to the ground potential is produced at one end of a winding 8 corresponding to the second ac power source 8 of FIG. 4. The other end of the winding 8 is connected to the transparent electrode 1. The windings 5 and 6 including the center tap 7 generate voltages of about ±3 volts with respect to the reference, i.e. the potential of the center tap 7.

The battery power source 9 is connected to the ground side of the smoothing capacitor 16 and the positive terminal of the battery power source 9 is connected to the grid 3 and a driver 20. Numeral 21 designates a glass tube and a vacuum is created within the glass tube 21. Numeral 4 designates the anodes which are separately connected to the driver 20. The surface of each anode 4 is coated with a fluorescent substance so that by causing the fluorescent substance to emit light, various forms of display can be confirmed in the direction of an arrow E.

The filaments 2 form cathodes and a voltage of ±3 volts is applied between their terminals 2*a* and 2*b* by the windings 5 and 6. Thus, a potential difference of 6 volts is created between the terminals 2*a* and 2*b*. Actually, the number of the filaments 2 is 5 to 10 so that they are arranged parallel to one another and the direction of current flow is the same in all of them. Numeral 23 designates a controller connected to the driver 20. In response to a command from the controller 23, the driver 20 determines which one or ones of the anodes 4 provided in the form of segments are to be supplied with the voltage. It is to be noted that where a central processing unit (CPU) is used as the controller, the controller is driven by a 5-volt power source and therefore a driver 20 is provided to apply therethrough the voltage of 10 volts from the first dc power source 10 to the anodes 4.

Although the detailed circuits of the controller 23 and the driver 20 are not shown, it is possible to use the controller and driver section of any of the various ordinary display units which are presently used in vehicles. For instance, the clock circuit for indicating the time on the fluorescent display tube may be used for this purpose.

With the construction described above, the operation of the embodiment will now be described. Since the ac voltage of ±3 volts is applied to each of the terminals 2*a* and 2*b* of the filaments 2, thermoelectrons are emitted from the filaments 2 so that the thermoelectrons impinge on the anodes 4 through the grid 3 and the anodes 4 emit light. In this case, a potential corresponding to the reference potential of the filaments 2, i.e. the potential of the center tap 7 plus the ac voltage of the second ac power source 8 varying in the range of ±3 volts is applied to the transparent electrode 1 and therefore the potential of the transparent electrode 1 is varied greatly. Thus, as shown in FIGS. 2 and 3, the thermoelectrons emitted from the filaments 2 are alternately changed to the condition of FIG. 2 and the condition of FIG. 3 in response to variations in the potential of the transparent electrode 1 and therefore the thermoelectrons impinge uniformly on the surface of the anodes 4. This results in the fluorescent display tube in which there is no emission irregularity, that is, there is no variation in emission among the different anodes.

A second embodiment of the invention will now be described with reference to FIG. 5.

Figure 5:
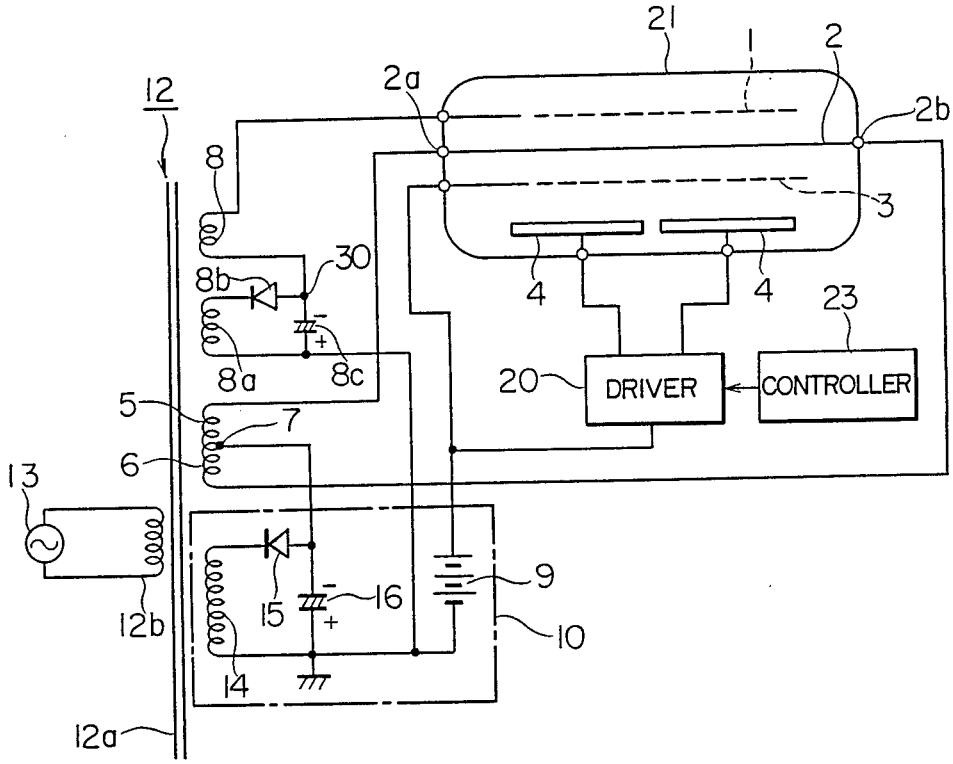
FIG. 5 is an electric wiring diagram showing a second embodiment of the drive apparatus according to the invention.

The embodiment of FIG. 5 differs from the first embodiment in that instead of applying an ac voltage varying on both sides of the potential of the center tap 7 or the reference as a potential to be applied to the transparent electrode 1, an ac voltage varying on both sides of a reference or a potential point different from the center tap 7 is applied to ensure more uniform emission of light. More specifically, while, in the circuitry of FIG. 1, a potential signal is applied to the transparent electrode 1 by using the center tap 7 as a reference and adding the ac voltage of the second ac power source 8 to the reference, the second embodiment is designed so that the voltage of the second ac power source 8 is added to the potential at a reference point 30 and the potential at the other end of the second power source 8 is applied to the transparent electrode 1. Thus, an alternating potential varying in the range of ±10 volts is applied to the transparent electrode 1.

In FIG. 5, the potential of the center tap 7 is set to −10 volts and the potential at the reference point 30 is set to −15 volts with respect to the ground. In other words, there is a constant potential difference of 5 volts between the reference point 30 and the center tap 7.

It is to be noted that the potential difference between the reference point 30 and the center tap 7 differs depending on the size, shape, etc., of a fluorescent display tube to be used and it can be selected arbitrarily each time. Also, the potential at the reference point 30 needs not always be shifted to the negative side with respect to the potential of the center tap 7 and it may be shifted to the positive side. However, there has been confirmed a general tendency that more uniform emission of light can be ensured by shifting the potential at the reference point 30 to become more negative than the potential of the center tap 7.

The operation of this second embodiment is the same with the first embodiment except the potential of the transparent electrode 1 varies about the potential of the reference point 30 which is shifted from the potential of the center tap 7. The flow of thermoelectrons changes alternately to the conditions shown schematically in FIGS. 2 and 3, thereby ensuring the uniform emission of light.

Figure 6A:
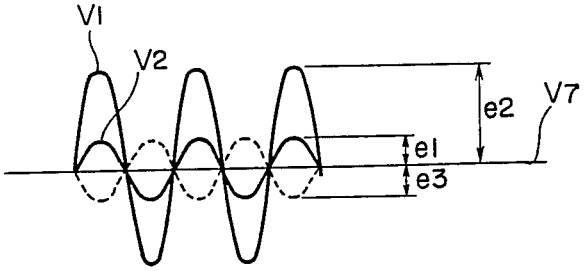
FIGS. 6(*a*) and 6(*b*) are waveform diagrams for explaining the mutual relation between the potential of the transparent electrode and the potential of the filaments, FIG. 6(*a*) corresponding to the embodiment of FIG. 1 and FIG. 6(*b*) corresponding to the embodiment of FIG. 5.
Figure 6B:
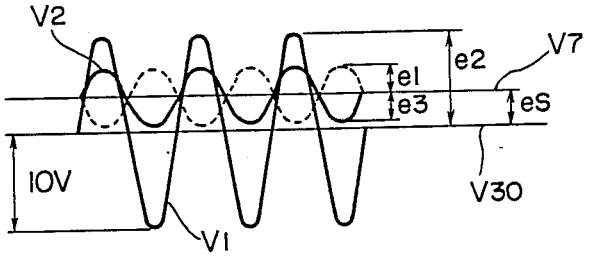
Figure 7:
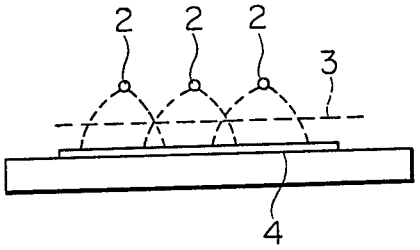
FIG. 7 PRIOR ART
FIG. 7 is a schematic diagram showing the emission condition of electrons in a conventional drive apparatus.
Figure 8:
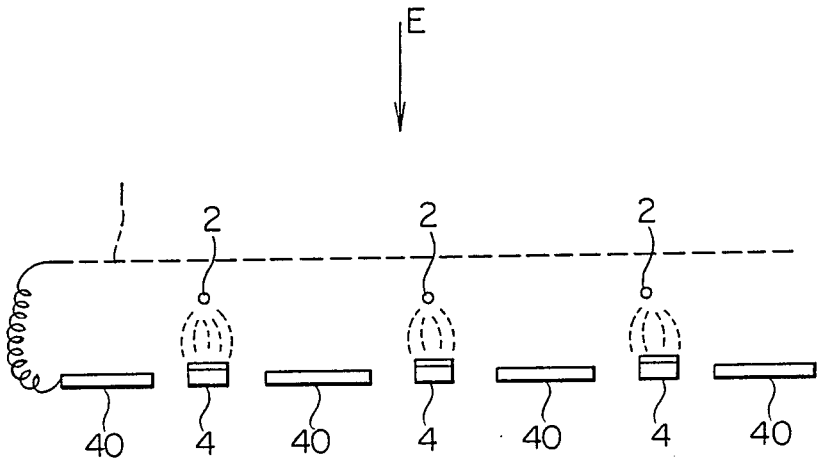
FIG. 8 PRIOR ART
FIGS. 8 and 9 are schematic diagrams for explaining prior art methods.
Figure 9:
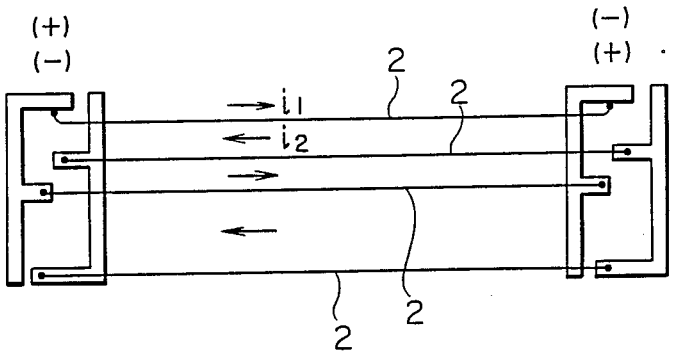
FIG. 9 PRIOR ART

The difference between the first and second embodiments will now be described in greater detail with reference to the waveform diagrams shown in FIGS. 6(*a*) and 6(*b*). FIG. 6(*a*) shows the waveform diagram for FIG. 1 and the center line represents the potential at the center tap 7. In other words, the line designated by $V_7$ represents the potential at the center tap 7. Then, an ac voltage varying in the range of ±3 volts with respect to this potential is applied to the filaments 2. This ac voltage of ±3 volts is represented by the solid line designate by $V_2$. Also, the values of $e_1$ and $e_3$ are 3 volts. The solid line waveform $V_2$ represents the potential at the terminal 2*a* of FIG. 1 and the waveform represented by a broken line symmetrical with $V_2$ shows the potential variations at the terminal 2*b*. A waveform $V_1$, which is the same in phase but different in amplitude with $V_2$, represents the voltage applied to the transparent electrode 1 and the peak value of $e_2$ is 10 volts.

Figure 1:
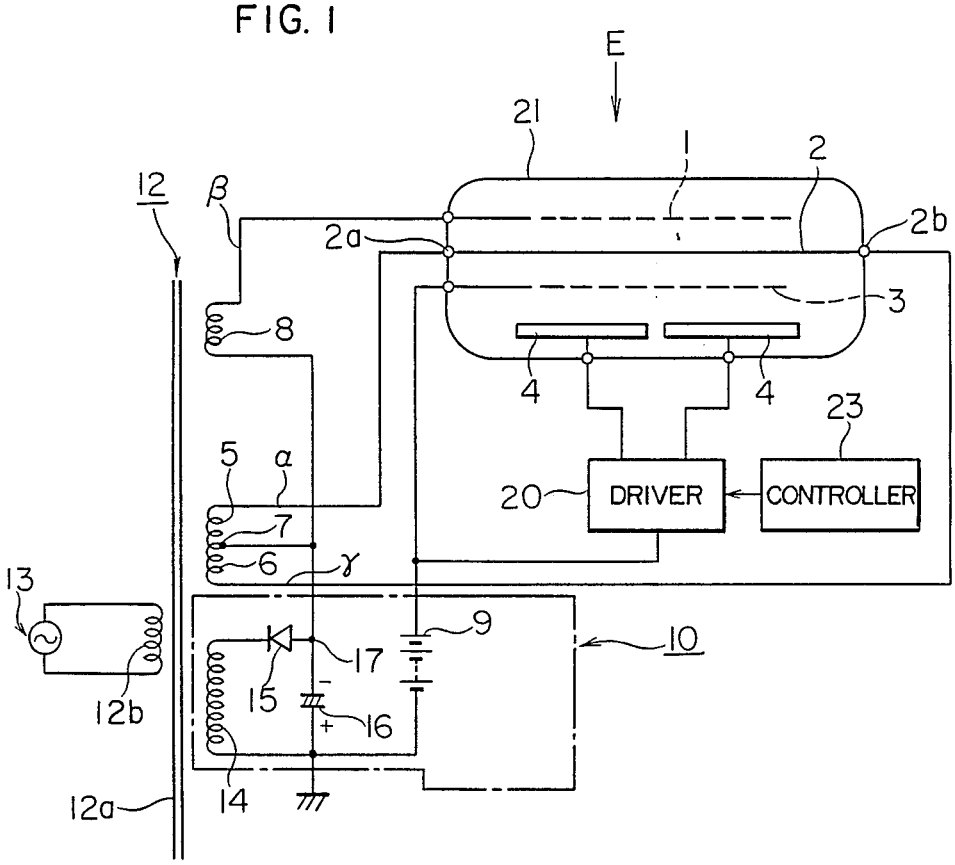
FIG. 1 is an electric wiring diagram showing a first embodiment of a fluorescent display tube drive apparatus according to the invention.

In this connection, the connections are such that the potential at a point $\alpha$ in FIG. 1 or the terminal 2*a* and the potential at a point $\beta$ of coil 8 are always the same in phase. On the other hand, the potentials at the points $\alpha$ and $\gamma$ are always opposite in phase and therefore the potentials at the terminals 2*a* and 2*b* are always opposite in phase. In other words, they are out of phase by 180 degrees.

Next, the waveforms generated in the circuitry of FIG. 5 will be described with reference to FIG. 6(*b*). Designated by $V_7$ is the potential at the center tap 7, and voltages in the voltage range of ±3 volts with respect to this potential are applied to the terminals 2*a* and 2*b* of the filaments 2. The potential at the terminal 2*a* varies as shown by the waveform designated by $V_2$. Also, the waveform indicated by a broken line shows the potential variations at the terminal 2*b*. Designated by $V_{30}$ is the potential at the reference point 30 so that the potential of the transparent electrode 1 is varied in the range of ±10 volts on both sides of this point and this potential variation waveform is shown by $V_1$. The potential difference $e_s$ (=5 volts) between the potentials $V_7$ and $V_{30}$ represents the shifted voltage level. Although no accurate reason has been known why the level shift between the potentials $V_7$ and $V_{30}$ has the effect of providing more uniform light emitting surfaces, it has been shown by various experiments that the shifting has resulted in more uniform light emitting surfaces in many cases and that good results have been obtained by selecting the amount of level shift in such a manner that the potential $V_{30}$ is shifted to the negative side with respect to the potential $V_7$, particularly when the potential $V_{30}$ is shifted to about the lower limit of the potential variations of the filaments or the waveform $V_2$.

It is to be noted that in the above-described embodiments, the plurality of filaments 2 are in the form of wires and they are arranged parallel to one another. Thus, the transparent electrode 1 may be one which extends in one plane or it may comprise a plurality of wire electrodes arranged in correspondence to the filaments 2. The grid 3 is of the ordinary type which extends in one plane and it may be eliminated. However, more uniform emission of light for display can be ensured by applying a given positive voltage to the grid as shown in FIGS. 1 and 5. Also, in FIGS. 1 and 5 the frequency of the transformer 12 is selected about 20 kHz. However, this frequency may for example be selected about 60 Hz and thus it is possible to arbitrarily select any frequency which would make the transformer smaller and more compact in construction. Also, the transparent electrode may take the form of a diffusing grid employing a Nesa coating.

While, in FIG. 5 a rectifying diode 8*b* and a smoothing capacitor 8*c* are connected to a winding 8*a* for applying a voltage to the reference point 30, these elements 8*a* to 8*c* may be replaced with a dc power source used solely for the voltage application. Numeral 12*a* designates the core of the transformer 12, and 12*b* its primary winding.

Also, while, in FIG. 1, the center tap 7 is connected to the second ac power source 8, one end of the second ac power source 8 may be connected to the α portion of the wiring instead of the center tap 7. In other words, the connections of the second ac power source 8 may be made as desired irrespective of the embodiment provided that a potential difference is developed between the transparent electrode 1 and the filaments 2 and that the potential difference pulsates with the passage of time. Also, while, the point 17 on the anode side of the diode 15 is connected to the center tap 7, if no consideration is given to the balancing of the potentials of the terminals 2*a* and 2*b* with respect to the ground, the point 17 needs not be connected to the center tap 7 and it is only necessary to connect the point 17 to one end of either the first ac power source 5 or 6.

On the other hand, in FIG. 6 the waveforms $V_1$ and $V_2$ need not be in phase and there can be any phase difference between the waveforms $V_1$ and $V_2$.

Also, in the respective embodiments the secondary windings of the transformer 12 are used to provide the first ac power sources 5 and 6 which apply ac voltages to the terminals of the filaments 2 to supply a current to the filaments 2. Also, the other secondary winding 8 of the transformer 12 is used to provide the second ac power source 8 for applying a pulsating voltage to the transparent electrode 1 to cause pulsation of the potential difference between the filaments 2 and the transparent electrode 1. Further, the center potential of the pulsating potential difference at one terminal of the filaments 2 or the potential $V_7$ of FIG. 6(*b*) is not the same with the center potential $V_{30}$ of the pulsating potential difference of the transparent electrode 1 and there is a constant dc potential difference between the center potentials $V_7$ and $V_{30}$. For this purpose, the center tap 7 shown in FIG. 5 is connected to the capacitor 16 of the first dc power source 10, and the capacitor 16 is connected through the diode 15 to the winding 14 and moreover the center tap 7 is connected to the negative side of the first dc power source 10. Still further, the capacitor 8*c*, the diode 8*b* and the winding 8*a* form a second dc power source having its ground side connected to the ground side of the first dc power source 10, and the winding 8 forming the second ac power source is connected to the negative side of the second dc power source.

The grid 3 is of the known fine-mesh type and a voltage positive with respect to the filaments 2 is applied to the grid 3 to attract the thermoelectrons emitted from the filaments 2. The value of this voltage may be selected arbitrarily.

From the foregoing, it will be appreciated that when the present invention is applied to bar-graph displays of meters for indicating rest-fuels, battery or temperature states in vehicles, they can be obtained with clean displays of uniform brightness.

What is claimed is:

1. A fluorescent display tube drive apparatus comprising:

a fluorescent display tube, which is at least partially transparent;

a filament enclosed within said fluorescent display tube for emitting thermoelectrons in response to an applied AC voltage;

an anode located on one side of said filament, for attracting said thermoelectrons, and having a fluorescent substance for emitting light when exposed to said attracted thermoelectrons;

a transparent electrode arranged on another side of said filament and spaced from said filament such that said filament is between said transparent electrode and said anode, thermoelectrons from said filament impinging on said anode without passage through said transparent electrode;

first ac power source means for applying said AC voltage to said filament; and second ac power source means for applying a pulsating voltage to said transparent electrode to cause a time-varying potential difference between said filament and said transparent electrode to thereby cause a spread of thermoelectrons striking said anode to change periodically in width over time.

2. An apparatus according to claim 1, wherein said second ac power source means includes means for varying the voltage between said filament and said transparent electrode by a voltage having a greater effective value than a voltage between said terminals of said filament.

3. An apparatus according to claim 1, wherein a center potential of a pulsating voltage at one terminal of said filament is different from a center potential of the pulsating voltage of said transparent electrode whereby a dc potential difference is produced between said center potentials.

4. An apparatus according to claim 1, further comprising a fine-mesh grid arranged between said filament and said anode to attract the thermoelectrons emitted from said filament.

5. An apparatus according to claim 1, wherein said first ac power source means comprises secondary windings of a transformer, said secondary windings including a center tap, and further comprising a dc power source arranged between said center tap and said anode whereby said center tap and said second ac power source means are connected to a negative side of said dc power source.

6. An apparatus according to claim 3, wherein said first ac power source means comprises a transformer having a plurality of secondary windings including a center tap, first means for providing dc power, arranged between said center tap and said anode, said center tap being connected to a negative side of said first means, and second means for providing dc power connected to a ground side of said first means, said second ac power source means being connected to a negative side of said second means.

7. A fluorescent display tube drive apparatus comprising:

a fluorescent display tube which is at least partially transparent;

a filament enclosed in said tube, for emitting thermoelectrons in response to a first AC voltage applied thereacross;

an anode having a fluorescent substance for emitting light when exposed to said thermoelectrons emitted from said filament;

a transparent electrode, wherein said anode and said transparent electrode are provided spaced from and on opposite sides of said filament respectively, thermoelectrons from said filament impinging on said anode without passage through said transparent electrode;

means for applying a first AC voltage across said filament;

means for controlling a flow of said thermoelectrons from said filament towards said anode to expose said anode to selective thermoelectron flow; and means for applying a second AC voltage to said transparent electrode to alternatively repel and attract said thermoelectrons, thereby causing said thermoelectrons to expose said anode uniformly.

8. A fluorescent display tube drive apparatus according to claim 7, wherein said second AC voltage is applied to said transparent electrode in phase synchronism with said first AC voltage applied across said filament.

* * * * *